United States Patent [19]

Alexander et al.

[11] Patent Number: 4,978,239

[45] Date of Patent: Dec. 18, 1990

[54] TEMPERATURE LIMITING APPARATUS AND METHOD FOR PRINTER

[75] Inventors: Randall W. Alexander; Demetrios Troupes, both of Charlotte, N.C.

[73] Assignee: International Business Machines Corporation, Armonk, N.Y.

[21] Appl. No.: 657,841

[22] Filed: Oct. 4, 1984

[51] Int. Cl.[5] ..... B41J 2/23

[52] U.S. Cl. ..... 400/124; 400/719; 400/54

[58] Field of Search ..... 400/124 TC, 124, 719, 400/54, 120; 219/216 PH; 346/76 PH; 361/381; 318/334, 472, 473, 634

[56] References Cited

U.S. PATENT DOCUMENTS

| | | | |
|---|---|---|---|
| 4,070,587 | 1/1978 | Hanakata | 307/141 |
| 4,326,813 | 4/1982 | Lomicka et al. | 400/124 |
| 4,541,747 | 9/1985 | Imaizumi et al. | 400/719 X |

FOREIGN PATENT DOCUMENTS

| | | | |
|---|---|---|---|
| 2844468 | 4/1979 | Fed. Rep. of Germany . | |
| 47673 | 3/1982 | Japan | 400/54 |
| 20517 | 12/1982 | Japan | 400/719 |
| 155981 | 9/1983 | Japan | 400/54 |

*Primary Examiner*—Clifford D. Crowder
*Assistant Examiner*—Joseph R. Keating
*Attorney, Agent, or Firm*—Kenneth A. Seaman

[57] ABSTRACT

A printer in which the heat build-up in the printhead is limited by determining whether the printhead temperature is at its temperature threshold. If so, the printing is not allowed to proceed untilt the printhead has cooled sufficiently so that the printing will not cause it to exceed its temperature threshold. The temperature limiting feature is accomplished by testing before each unit of printing whether the temperature of the printhead is below the threshold and therefore printing may occur as usual or whether to take some action to limit the temperature, analyzing the activity during each time period to determine whether heating or cooling of the printhead is occurring, and adjusting the present (calculated) temperature of the printhead accordingly. In the preferred embodiment, the temperature calculation is stored in memory and initialized at the threshold initially, then if no printing occurs during a given period, cooling of a given portion of the assumed temperature (accomplished by shifting a binary representation by a given number of bits) is accomplished. If during any period printing has occurred, the amount of printing in terms of number of print elements actuated is multiplied by a heat factor per print element actuated which is added to the temperature. In some instances, both heating and cooling can occur and are netted out with the temperature being adjusted by the difference.

9 Claims, 4 Drawing Sheets

TEMPERATURE LIMITING APPARATUS AND METHOD FOR PRINTER

CROSS REFERENCE TO RELATED PATENTS

U.S. patent application Ser. No. 576,312, entitled "Wire Driving Armature for Dot Printer" filed Feb. 2, 1984 by J. H. Meier and D. W. Hanna and assigned to the assignee of the present invention, discloses a printer and printhead assembly which is suitable for use in connection with the present invention. The disclosure of this patent application, sometimes referred to as the "Printhead Patent", is specifically incorporated herein by reference.

BACKGROUND OF THE INVENTION

FIELD OF THE INVENTION

The present invention relates to an apparatus and method for limiting the temperature of a printhead during printing to protect it from heat damage. More particularly, the present invention relates to a system for preventing the overheating of the printhead based upon an estimate of its present operating temperature, in its preferred embodiment through algebraic calculations.

DESCRIPTION OF RELATED ART

Advantageously, a printer includes a print element or printhead which is small and light. A small and light printhead allows operation of the printhead at a relatively high speed while conserving power. In such printers, the use of heat sinks and other heat dissipation apparatus is kept to a minimum to limit the manufacturing and assembly cost as well as the weight of the printhead assembly. This permits the weight (and hence the inertia) of the printhead to be kept low.

One form of such printers is a "wire matrix" printer in which a plurality of spaced wires are selectively driven into a ribbon to contact a piece of paper at spaced locations to create a desired pattern of dots, which together form recognizable images, such as letters, graphs or other art work. Other printers use hammers to impact a ribbon, either directly or indirectly, to print a pattern on a paper. The wires of a wire matrix printer or the hammers of an impact printer are driven electrically (generally through use of a coil) which, when appropriately energized, propels selected hammers/wires, as the case may be, in a manner suitable for printing at a desired location.

Heat is generated during printing which may accumulate. With the use of printers for printing graphics as well as text, the amount of heat generated varies significantly depending on the type and amount of printing which a printhead experiences during its operation—as well as the time in between printing during which the printing content is determined and sent to a buffer to await printing. In a calculating mode, the printer may have idle periods in between batches of printing sufficient to dissipate heat so that heat never builds up to an unacceptable level. On the other hand, during the printing of dark graphic material, considerable amount of printing (many wires of a wire matrix) may be engaged within a short period, because the calculation mode is very small. In such cases, the printhead may build up heat to a level which damages the coils which drive the print elements.

It is desirable to monitor the operating temperature of the printhead and modify the operation of the printhead in response thereto. The prior art has suggested ways to do so, either by measuring the actual temperature of the printhead (e.g., mounting a thermocouple within the printhead) or by calculating the amount of printing programmed for a given line, then adjusting the rate of printing if the amount of printing programmed for that line exceeded a fixed level.

Neither approach works well under the widely varying environments encountered during printer operations of current applications for the dot-matrix printers in the current environment where a given printer may be used by one user to print low density, interrupted typing or printing (generating little heat, with much idle time for cooling), while the next user generates graphical material having high density, closely spaced in time printing generating substantial heat and little cooling. The thermocouple approach is disadvantageous in that the sensed temperature within the thermocouple lags behind that of the coil in high speed volume printing, allowing the coil to burn out before the thermocouple senses the high temperature and takes the steps necessary to control it. Inherent disadvantages of the thermocouple approaches to monitor and control printer operation are the disadvantages of having to pay the cost of the thermocouple, maintaining and/or servicing the thermocouple throughout the life of the printer, and the associated electronics and controls to use a thermocouple. Additionally, the design and manufacturing complexity of a printhead increases substantially when the printhead must include an integral thermocouple.

The calculation of the amount of printing on each line, and limiting the printer operation for that line when the printing of that line exceeds a threshold ignores the capability of a printhead when cold to print high density material. In essence, then, the line-by-line analysis is unduly limiting in the speed of the printer. It is also a system which overlooks the cooling capabilities of a printer in its customary applications.

Another printer configuration ignores the heat problem completely during operation, either by designing the printhead for the worst case design (printing solid black lines) or by hoping that the user will not select a mode of operation which generates printhead temperatures which exceed the desirable operating temperature of the elements of the printhead. Worst case designing is expensive to manufacture and results in a slow operation system, while ignoring the problem may solve the manufacturers' problem but increases the user's cost and maintenance problems.

Once the conclusion to incorporate a particular function such as heat calculation has been determined, a question exists how that function will be implemented. Hardware, software or some combination of hardware and software are the choices a designer has today regarding any given function. Hardware requires physical elements to be selected, valued and assembled within the device. A software implementation requires a processor and a memory along with appropriate interconnections. Generally, a printer for a computer includes a processor, but it may or may not have access to the processor. Even if the printer has access to the processor, a sufficient amount of memory must exist in which to store a suitable program to accomplish all function required of the machine. It is thus a limitation of software type solutions that memory is limited and that the functions must economize on the limited storage that memory is limited and that the functions must economize on the limited storage of the device.

U.S Pat. No. 4,326,813 to Lomicka et al., discloses, especially at Column 17, the limit on carriage speed is partially a function of dot density over a time interval so that the solenoid does not exceed its limits. Further, in blank (no printing) regions, the carriage may move at a faster speed than in printing areas. However, this does not address the fact that the history of printing or the amount of printing in a given region may influence how fast a printer can be safely operated.

Other prior art patents which have been discovered include U.S Pat. Nos. 2,665,792 and 4,070,587. The former relates to a typewriter having a thermo-responsive element for automatically eliminating power when the typewriter has been left on for a period exceeding a predetermined time. The second patent discloses a printer which will print for a limited period only, then require a quiescent period.

Temperature simulation algorithms in the form of computer software programs have been known and used for many years in the computer modeling and computer assisted design field. These programs, while quite sophisticated in considering the environment, geometry and materials, do not operate in real time or control real processes such as printing as characters and other printed symbols are being generated.

Accordingly, the printer control systems of the prior art have deficiencies and limitations. These limitations are in the areas of speed and safety of operations, key areas of printer performance.

SUMMARY OF THE INVENTION

Our invention overcomes the limitations and disadvantages of the prior art printer systems by providing a system for estimating the present operating temperature of a printhead without a thermocouple or other direct temperature sensor. The present apparatus and method for calculating the temperature of the printhead include means for sensing whether printing will occur during a period of time. If printing will occur, the temperature is incremented by an amount having an algebraic relation to the amount of printing which has occurred, e.g., by an amount of heat generated by the actuation of each wire in a wire matrix printer. The present system also recognizes that cooling occurs based on temperature and this occurs as time passes, whether or not printing occurs. The temperature is reduced by an amount of cooling which the printhead has experienced during the period, e.g., by an amount proportional or related to the temperature of the printhead.

The invention is characterized by the efficient use of memory in software program which is simple, efficient and reasonably accurate. The program calculates the temperature in a real time situation, allowing decisions about printhead operation to be made based upon current information. This allows the printhead to be operated at maximum speed until the printhead temperature reaches a predetermined temperature level, then requires the printhead to operate in another (cooling) mode until the temperature is reduced below the threshold at which time the unrestricted operation of the printhead may be resumed.

During printing operations, both heating and cooling of the printhead occur and any system for monitoring the temperature must take into account the cumulative effects of both phenomena. Of course, the heating is a function of variables which differ from those which are related to the amount of cooling.

The present system is flexible in that the variables (such as maximum allowable temperature, heating relation to printing, and cooling rate) can be adjusted either in response to experimental data, safety regulation or usage experience. That is, if usage determines that printheads are burning up at one threshold, a lower threshold can be programmed in.

The present method has particular application to the generation of graphic material by computer at high speed, which later are transmitted to a printer for printing. The present invention is characterized by a buffer including a column of material ("dots") to be printed during a succeeding time period. The number of print elements ("wires") to be activated to print that column has been found to be directly proportional to the amount of heat generated during the period. The cooling rate has been found to be approximated by a function of a portion of the temperature of the printhead above the ambient temperature and the time period.

The present invention has the advantageous effect that the calculation of heat is not dependent on the size of characters, the dot density (at least, not directly), nor the type of material being printed (e.g., graphics).

The foregoing and other objects and advantages are accomplished by the apparatus and method of the present invention. Other objects and advantages of the present invention will be apparent to those skilled int the relevant art from the detailed description of the present invention, taken together with the appended claims and the accompanying drawings.

BRIEF DESCRIPTION OF THE DRAWINGS

FIG. 2 consists of FIG. 2A which is a block diagram of portions of the background code and FIG. 2B which is a block diagram of a temperature calculation algorithm.

DESCRIPTION OF THE PREFERRED EMBODIMENT

Figure 1:
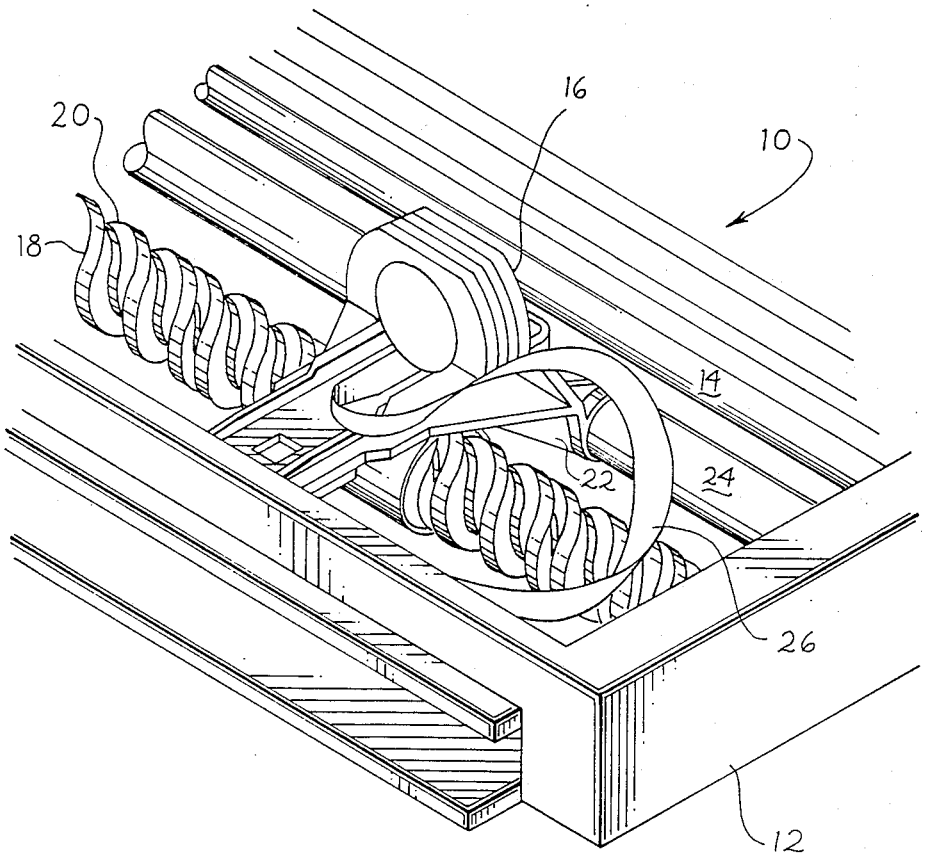
FIG. 1 is a perspective view of a part of a printer assembly for use in the present invention, showing its principle elements.

FIG. 1 is a perspective view of a portion of a printer assembly 10 suitable for use in connection with the present invention. The printer assembly 10 includes a housing 12 (only partially shown) which encloses a printing area. Within the printing area are a platen 14 and printhead 16. The printhead 16 is advanced laterally with respect to the fixed platen 14 by a lead screw 18 which includes a helical projection 20. The printhead 16 includes guide collars 22 extending from its lower portion which are received on and guided in their path by a guide rod 24.

The printhead 16 is coupled to a processor (not shown) by a flexible cable 26 for both signal and power. The flexible cable 26 is a ribbon consisting of multiple wire conductors of a type which is both well known and commercially available.

The printhead 16 may be of the type described in the Printhead Patent, in which a plurality of print wires are positioned with a first end of each wire is adjacent a ribbon which, in turn, is adjacent an article on which printing is to occur. The article is supported by the platen 14 from behind. The other ends of the print wires are selectively driven by respective electromagnets to cause the first ends to impact the ribbon and cause printing in desired locations on the article. The position of the wires determines the location of the printing on the paper. The energization of the respective electromagnets permits the print wires to overcome retracting forces applied by a spring and/or a magnet. The spring and/or magnet also serves to return the print wire after printing when the signal is removed from the electromagnet. For a more detailed explanation of the structure and function of the printhead, the reader is referred to the Printhead Patent.

Advantageously, the printhead 16 includes nine wires arranged to print a selected locations along a vertical column. After the printing at a first vertical location, the printhead 16 is advanced horizontally by means of the lead screw 18 and the guide rod 24 to a next position where points along another vertical column may be printed.

Each energization of an electromagnet generates heat and results in heating of parts. Heat sinks in the form of a stack of disk-like fins surround the printhead 16 and provide for dissipation of some heat.

Figure 2A:
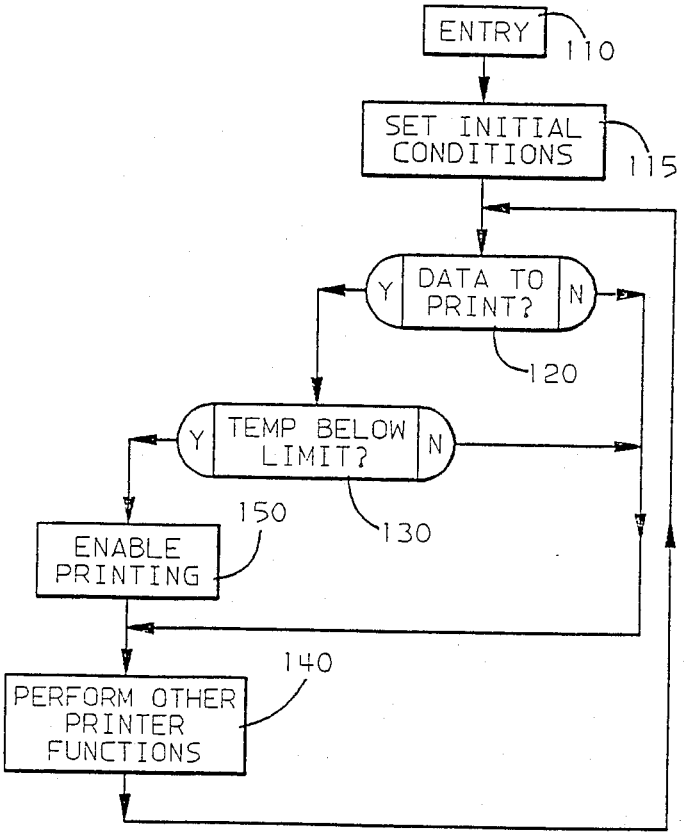
FIG. 2 is a block diagram of the temperature calculation and limiting method of our invention.
Figure 2B:
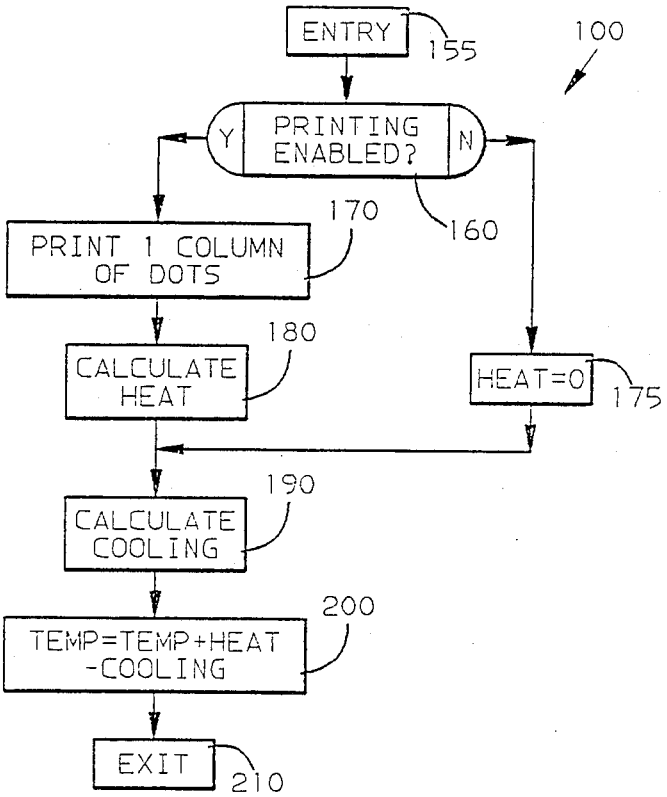

FIG. 2 is a block diagram of the computation and logic system 100 used in the preferred embodiment of the present invention. The logic system 100 includes background code in FIG. 2A and a temperature calculation algorithm in FIG. 2B. In FIG. 2A, the background code has an entry 110 when the system is initialized. At block 115, conditions are initialized including the starting value for the temperature and a clock is set up to generate interrupts for the temperature calculation algorithm of FIG. 2B every 416 microseconds (2400 times per second). As shown in this view, from the initial conditions block 115, the system 100 proceeds the block 120 where whether there is data to be printed is determined. If so, at block 130 the system determines whether the temperature is below the threshold. If there is no data to print at the block 120 or the temperature exceed the threshold at the block 130, then the printer is limited to performing non-printing functions as depicted by the block 140. These non-printing functions, which may include advancing the paper or receiving data or communicating with the host or running diagnostic routines, do not increase the temperature of the printhead, and therefore can be accomplished even when the printhead is at a high temperature. If there is data to print at the block 120 and the temperature is below the limit at the block 130, then printing of data is enabled at the block 150 which permits one buffer to be printed. From the block 140, the program returns to the block 120 where it again decides whether there is more data to print.

Printing and temperature calculating algorithms are depicted in FIG. 2B. Entry to this chart at block 155 occurs every 416 microseconds whether there is printing or not and whether printing is enabled or not. At block 160, whether printing is enabled is determined (from the block 150 in FIG. 2A). If so, at block 170 one column of dots (e.g. 9 dots or less) are printed. If not, at block 175, heat equals 0, since no printing will occur.

The amount of heat and the amount of cooling are calculated at blocks 180, 190, respectively. At block 200, the previous calculated temperature is adjusted by adding to it the amount of heat generated and deducting from it the amount of cooling which have occurred during the cycle. From the block 200, the program exits at the block 210. In the preferred embodiment, each cycle is 416 microseconds and an interrupt repeats the cycle at entry 155, allowing 2400 cycles per second.

The block 180 regarding the calculation of heat generates its result by multiplying the number of wires by an amount of heating which occurs as a result of the energization of each print wire. As determined experimentally, in the system of the Printhead Patent, 12 units of heating (in the arbitrary units of the binary storage location) each representative of an amount of temperature, approximately two ten-thousandths (0.0002) degrees Centigrade are generated per wire energization.

The block 190 regarding the calculation of cooling generates a result based upon the present temperature of the printhead as stored as temperature. Here, as elsewhere in this description, the temperature is an expression based upon units above ambient temperature outside the printhead. The formulas used divides the present temperature (stored value) by 2 to the 19th power (which is approximately 500,000) since in each time period of 416 microseconds that is the approximate amount of cooling which the printhead experiences.

The initialized conditions for the temperature can be set by the user. The safest condition to assume (when the printer is first turned on) is that the printhead is at its upper threshold (from which it begins to cool, but at which no printing can initially occur). That assumption prevents a user from circumventing the system limiting the heat of the present invention by turning printer off and on again to keep printing on an overheated system. As another initial operating assumption for the printhead temperature, the temperature of the printhead upon turn on could be assumed to be the ambient (or zero), which would be approximately true if the printer had been off for a significant time. Other alternates include storing a last printhead temperature and initializing the next turn on at that value, storing a time of turn off and calculating an operating temperature initially from the time elapsed, or other ways which those conversant with the technology of temperature approximation might devise in view of the teachings of this patent, experience, and testing. Since the present system enables to printing of an entire buffer as a result of a single temperature versus threshold, that threshold must be sufficiently below the burn-out or failure point of the printhead so that whatever printing the buffer may require will not allow the temperature to reach the failure point. Additionally, the threshold can be adjusted for a safety factor or any safety standards (such as the printhead must not burn a user who touches it.)

Figure 3:
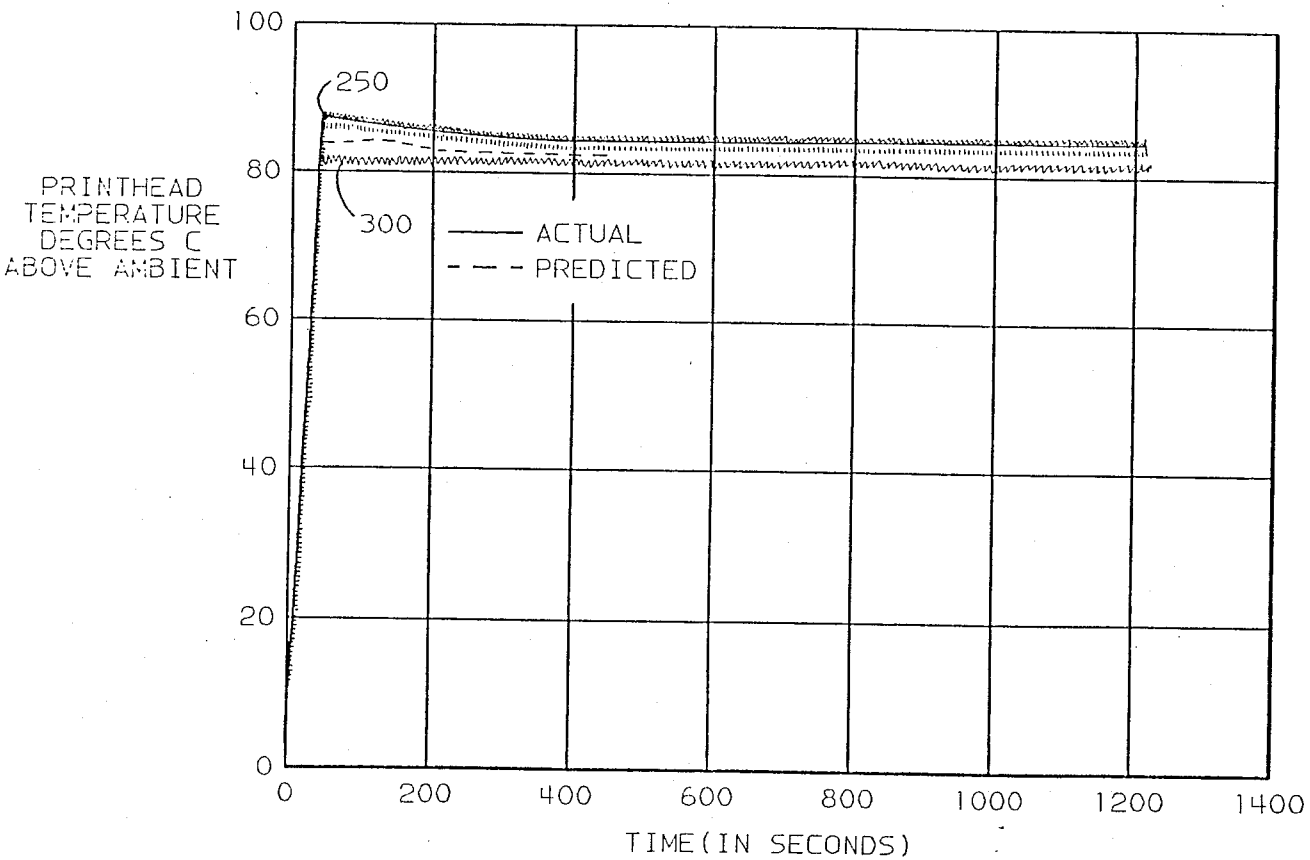
FIG. 3 is a plot of printhead temperature (both actual and calculated) versus time, showing the close approximation of operating temperature of the printhead in one illustrative test using the present techniques for temperature prediction.

FIG. 3 is a plot of the temperature which the printhead 16 experienced during a printing operation, including "actual" values 250 and both "calculated" values 300. The calculated values 300 resulted from the temperature algorithm of the present invention. The actual values 250 were the results of a simulation using a mathematical model which was verified and found accurate in comparison with temperature of the printhead as sensed by a thermocouple mounted to the printhead, during experimental printing operations (the standard printhead does not normally include a thermocouple.) In this example, the temperature on turn on (time=0) was assumed to be 7 degrees Centigrade (above the ambient) and the printhead 16 was operated at full printing (all nine wires energized each cycle), a condition which has been determined to be the worst case for the prediction formula of the present invention. This printing using all nine print wires at each occurrence permitted is representative of printing a black background or a reverse image. As depicted, the printhead temperature quickly rises (in approximately 40 seconds) to its temperature threshold, at which it must wait without printing for a period of 2–3 seconds before printing for a period of approximately 2 seconds, at which the wait/-print cycle repeats under these circumstances. Of course, use of less than all the print wires, which is a far more common situation, would allow a greatest printing period and a lower amount of waiting. In the instance of printing conventional text for example, the blank space and letters which do not employ all of the print wires lead to a temperature situation in which the printer would rarely reach the temperature threshold.

As described later in this patent, a calculated temperature is stored in three bytes, one of which may be described as the most significant byte, namely, the byte having the most significant digits of data and for which carries or overflow from an other less significant bytes is stored.

The temperature threshold is another variable which has to be set for each printhead in some manner. In the example printhead described in the Printhead Patent, this value has been found to be when the third and most significant byte (8 bits) has value of "5F" in hexadecimal (or 01011111 in binary). This value was established and verified experimentally, although it is dependent on the values chosen for the what each count in the temperature count represents and how the printhead is configured in its geometry and heat-dissipating capacity.

In its preferred embodiment, the algorithm of FIG. 2 is implemented a stored program substantially as described below. Of course, other implementations are feasible and mere matters of design choice based upon the circumstances presented. For example, the program steps could be translated into hardware if desired. The program, which is partially dependent on the particular machine and its complement of operating instructions, is as follows:

initial conditions:

Temperature stored in three bytes: HEAT2 (most significant), HEAT1, HEAT0; status of printwires stored in R4 (first 8 wires), and WIRE9 (9th wire)

| LOCATION | LABEL | FUNCTION | OPERANDS | COMMENTS |
|---|---|---|---|---|
| 01 | AA | store | A, R4 | store R4 into A |
| 02 | | load | R6, "9" | loads 9 into R6 |
| 03 | | load | C, WIRE 9 | carry (C) = wire 9 status |
| 04 | | load | R, "0" | initialize R7 = 0 |
| 05 | AB | jump on no carry | AC | go to AC if C = 0 |
| 06 | | increment | R7 | R7 = R7 + 1 |
| 07 | AC | rotate right w/carry | A | shift A right 1 bit, right bit into C |
| 08 | | decrement, jump > 0 | R6, AB | go to AB if R6 > 0 (above calculates # of printwire fires) |
| 09 | | load | B, R7 | #fires into B |
| 10 | | load | A, "12" | A = 12 |
| 11 | | multiply | A, B | A = A(B) |
| 12 | | store | R7, A | R7 = A (R7 = amt heat) |
| 13 | AD | load | A, HEAT2 | get third byte of temp |
| 14 | | rotate left | A | bits 6543 to left half |
| 15 | | swap halves | A | bits 6543 to right |
| 16 | | AND (LOGICAL) | A, "OF" | Mask out left half |
| 17 | | STORE | C, A3 | C = 3 of A |
| 18 | | ADD w/carry | A, "0" | Add |
| 19 | | complement | A | complement A |
| 20 | | increment | A | add 1 to A (A = -cooling) |
| 21 | | add | A, R7 | A = heat-cooling |
| 22 | | load | R6, "0" | |
| 23 | | jump no b | A, AE | update temperature by |
| 24 | | load | R6, "255" | adding heat or |
| 25 | AE | add | A, HEAT0 | subtracting cooling to |
| 26 | | store | HEAT0, A | the stored temperature |
| 27 | | load | A, HEAT1 | (HEAT0, HEAT1, HEAT2) |
| 28 | | add c | A, R6 | |
| 29 | | store | HEAT1, A | |
| 30 | | load | A, HEAT2 | |
| 31 | | add c | A, R6 | |
| 32 | | store | HEAT2, A | |

Of course, many modifications can be made to the preferred embodiment of the present invention as previously discussed without departing from the spirit of the present invention. For example, the initial starting condition may be sensed by a thermocouple or some other method. Also, information relating to when the printer was last exercised may be available, allowing a better method for initializing the printer temperature upon turn on. The particular method has been described for a dot printer in which activation of each element generates an equal amount of heat. However, the present invention is not limited to a dot printer and could be used in connection with a line printer or a band printer. Further, the activation of some print elements could be considered as generating more or less heat that the activation of others, either because of the generation of greater heat or the position which might allow either less or greater cooling of the heat which is generated therefrom. Accordingly, the foregoing description should be considered as merely illustrative of the present invention and not in limitation thereof, as the claims which follow are the sole measure of the present invention.

Having thus described the invention, what we claim as our invention is:

1. A printer of the type including a printhead for printing a sequence of symbols and means for limiting the operating temperature of the printhead by adjusting the operation of the printhead when the temperature of the printhead exceeds a preset threshold, the improvement wherein the means for limiting the temperature includes:

means operative at a first time for storing a value representative of an assumed initial operating temperature of the printhead at that first time;

means responsive to the sequence of symbols printed by the printhead for periodically modifying said value based upon the symbols printed and the amount of time since the value was stored or modified; and means responsive to the value when the value exceeds the preset threshold for limiting the operation of the printhead to prevent the overheating of the printhead, whereby the operating temperature of the printhead can be dynamically estimated and controlled.

2. A printer of the type described in claim 1 wherein the initial operating temperature of the printhead is arbitrarily chosen to equal the preset threshold and the first time is when the power is first applied to the printer during an operating period.

3. A printer of the type described in claim 1 wherein the means for modifying the stored value includes means for adding a predetermined temperature increment to the stored value for each print element in the printhead engaged since the last modification if at least one print element has been engaged since the last modification.

4. A printer of the type described in claim 1 wherein the means for adjusting the stored value includes means for decreasing the stored value by an amount having an algebraic relation to the present stored value if no print element has been engaged since the last modification to the stored value.

5. A method of controlling the operation of a printhead to minimize its risk of heat damage from operation at is threshold while allowing the printhead to operate at high speed when its temperature is below its threshold, the steps of the method comprising:

generating and storing in memory a value assumed representative of a operation temperature of the printhead when the printhead is first activated;

periodically updating the value stored in memory by incrementing the value stored in memory for each unit of printing of the printhead based upon an estimate of the amount of printhead heat generated during the period if printing has occurred during the period and by decrementing the value stored in memory for each period of time if the printhead has been idle during the period based upon an estimate of the rate of printhead cooling resulting from the idle period; and adjusting the rate of printing when the value in memory exceeds the threshold, whereby the printhead may be operated at optimum speed without risk of overheating.

6. A method of controlling the operation of a printhead as described in claim 5 wherein the step of incrementing is based upon the number of print wires which have been engaged in the previous period of time.

7. A method of controlling the operation of a printhead and described in claim 5 wherein the step of decrementing the temperature stored in memory is based upon an algebraic function of the stored value and amount of elapsed time.

8. A method of controlling the operation of a printhead as described in claim 7 wherein the algebraic function to decrement the temperature includes the further step of shifting a representation of the stored value by a predetermined number of digits to divide it by a predetermined amount.

9. A method of controlling the operation of a printhead as described in claim 5 wherein the step of periodically updating the value includes timing a preset interval, determining if printing has occurred during the interval, determining how much printing has occurred during the interval, approximating the amount of temperature change the printhead has experienced during the interval and adjusting the value by the approximated amount of temperature change.

* * * * *